United States Patent [19]

Lindstrom

[11] Patent Number: 4,658,980

[45] Date of Patent: Apr. 21, 1987

[54] TAMPER EVIDENCING PLASTIC CAN TOP

[75] Inventor: Robert O. Lindstrom, Bay Village, Ohio

[73] Assignee: SCM Corporation, Iselin, N.J.

[21] Appl. No.: 792,627

[22] Filed: Oct. 25, 1985

Related U.S. Application Data

[63] Continuation-in-part of Ser. No. 698,711, Feb. 6, 1985, abandoned.

[51] Int. Cl.[4] ..... B65D 41/32

[52] U.S. Cl. ..... 220/214; 220/266; 220/254; 220/307; 220/339

[58] Field of Search ..... 220/214, 254, 339, 307, 220/266, 254, 258; 222/591, 153, 531, 545, 480, 541, 151, 481, 482, 483, 485, 486, 487; 206/538

[56] References Cited

U.S. PATENT DOCUMENTS

| | | | |
|---|---|---|---|
| 3,397,823 | 8/1968 | Kirkpatrick | 222/480 |
| 3,542,235 | 11/1970 | Hidding | 222/153 X |
| 3,737,066 | 6/1973 | Ames | 220/254 |
| 4,361,250 | 11/1982 | Foster | 220/307 X |
| 4,453,648 | 6/1984 | Harris et al. | 220/1 T X |
| 4,463,869 | 8/1984 | Lewis | 220/339 X |

*Primary Examiner*—Steven M. Pollard
*Attorney, Agent, or Firm*—Richard H. Thomas

[57] ABSTRACT

A container cap comprising a cover member, at least one opening in the cover member, lid means including at least one lid to close said opening, flexible hinge means connecting the lid means to the cover member, and defining a free edge opposite said hinge means, and tamper evidencing means in the form of arrowhead locks positioned at opposite corners of said free edge secured to the cover member, including breakable webbing connecting said locks to said lid means.

11 Claims, 7 Drawing Figures

TAMPER EVIDENCING PLASTIC CAN TOP

This is a continuation-in-part of co-pending application Ser. No. 698,711 filed on 2/6/85, now abandoned.

The present invention relates to plastic container caps, and particularly to a novel tamper evidencing means for such caps.

The present invention is particularly concerned with molded plastic container caps of the type having a base cover member attachable to a container and at least one lid hinged to the cover member and foldable on the hinge into a superimposed relationship with the cover member, the cover member, hinge and lid being molded in a flat or open relationship as an integral single piece.

The present invention will be particularly described with respect to containers for particulate food condiments such as spices, where a consumer may be provided with a plurality of different types of openings in the cover, for instance an opening for sifting, one for pouring, and one for spooning, although it will be apparent to those skilled in the art that the present invention has many other applications. In the case of such containers having a plurality of different openings, the cap is likely to have a plurality of lids for closing the separate openings in the event only one of the openings is to be used. By the present invention, tampering with any or all of the lids would be readily noticable by a would-be consumer.

BACKGROUND OF THE INVENTION

An example of a container and dispensing closure of the type to which the present invention is directed is shown in Kirkpatrick U.S. Pat. No. 3,397,823, assigned to assignee of the present invention. As with the present invention, the container and closure of the U.S. Pat. No. 3,397,823 are adapted for containing granulated, powdered, or comminuted material such as spices and other condiments. The closure is of a plastic material provided with a first cover member having different types of openings and a plurality of lids hinged to the cover member to close the openings.

Since the closure is made of a plastic material, an important consideration is designing it so that virtually all parts of it can be molded in only one molding step as an integral single member. This is normally accomplished by using a somewhat flexible plastic material for the closure and designing the hinge connections so that they are relatively narrow for enhanced flexibility. This permits the closure to be molded in a flat or open position.

Due to the elastic or memory nature of the hinges, they will tend to cause the closure to resume the open position in which they are molded. A releasable latching means holds the lids in a closed position against the elasticity of the hinge or memory.

Also, reference can be had to prior U.S. Pat. No. 3,542,235, to Walter E. Hidding, which also shows a spice can cover of the type to which the present invention is directed.

U.S. Pat. No. 4,361,250, to John A. Foster, describes a plastic container closure having a top panel and a flap hinged to the top panel. The flap is initially locked to the top panel by means of plastic strips extending along the sides of the flap, secured to the top panel by pins, and connected to the flap by breakable webbing. To open the flap, it is necessary to break the webbing, providing evidence of tampering to a would-be purchaser. The flap moves from a closed position to an open position at about 90° with regard to the closed position, and the component parts could not be molded in a flat, open position as in the present invention.

In Lewis U.S. Pat. No. 4,463,869, there is disclosed a similar type of lid, attached to a dispensing container, and covers for a pair of appertures formed in the lid. The covers are recessed in the lid so that the only way they can be raised is by lifting on a flap for each cover. The flaps are also recessed and can be only grasped by breaking a frangible connection between the flaps and the covers, which breaking would be evidence of tampering to a would-be purchaser.

In copending application Ser. No. 565,737, filed 12/27/83, to Hart et al, assigned to assignee of the present application, there is shown a first cover member adapted to be affixed to a container, a second cover member having arrowhead projections permitting it to be fastened to the first cover member when folded over against the first cover member into a superimposed relationship with the cover member, the first and second cover members being connected by a flexible hinge, and lids hinged to the second cover member adapted to close aperture means in the first cover member. In said copending application, a tampering evidencing means is provided in the form of a bar connected to both of the lids and the second cover member, which has to be removed for the lids to be raised and access to be gained to the apperture means in the first cover member. Removal of the bar would be evidence of tampering to a would-be purchaser. The arrangement of this application is primarily suitable for what is called end-mounted lids. The present invention, by contrast, is particularly suitable for side mounting of lids.

A principal problem with all plastic closures and lids, particularly where flexible hinge portions are required, is that they are made of relatively resilient, deformable material. Thus, in the case of relatively long hexagonal lids, it is necessary to secure the lid at a plurality of points around the periphery to prevent tampering, since securing a lid at only one point, in addition to a hinge point, may still permit a corner or portion of the lid to be raised by one interested in tampering.

DISCLOSURE OF INVENTION

The present invention resides in a novel tamper evidencing means for containers, which is constructed of a molded, plastic material, comprising; a cover member adapted to be secured to the container; means defining at least one opening in said cover member; a lid means; flexible hinge means connecting said lid means to said cover member by which said lid means is foldable over onto the cover member into a superimposed relationship to cover said cover member opening; said cover member, lid means and flexible hinge being moldable in an open position as a single integral unit; and tamper evidencing means in said lid free edge in the form of at least one arrowhead lock securing said free edge to the cover member, said arrowhead lock including weakened means adapted to rupture and exhibit an exposed ruptured surface on first raising said lid from said superimposed relationship.

In one embodiment, the arrowhead lock shank portion comprises breakable webbing connected between the lid and shank portion, the shank portion comprising an arrow configuration at its free end adapted to non-releasably penetrate an aperture means in the cover member aligned with the lock, the shank portion being provided with a shoulder of larger diameter than said aperture means to retain the shank protion in the aperture means when the webbing is ruptured.

In a second embodiment, the arrowhead lock is molded integral with the cover member and is provided with an arrow configuration at one end adapted to non-releasably penetrate a hole in the lid aligned with the lock when the cover member and lid are in a closed superimposed relationship. In this embodiment, the weakened area is in the arrowhead lock shank.

In both embodiments, the lid is provided with a recessed area adapted to engage the arrowhead lock so that the exposed surface of the lock is approximately flush with the exposed face of the lid.

BRIEF DESCRIPTION OF DRAWINGS

The present invention will become more apparent upon consideration of the following specification, with reference to the accompanying drawings, in which

Referring to FIGS. 1 and 2, the container cap 12 comprises a rectangular shaped cover member 14 and a plurality of lids 16,18 and 20 hinged to the cover member by hinges 22, 24 and 26, respectively. The cover member is provided with openings 28, 30 and 32, FIG. 2, shaped for pouring, spooning, and sifting, respectively. The arrangement of components is frequently described as "side-mounted", since the hinges 22–26 are positioned along one of the sides of the cover member 14 rather than one of the ends. By way of comparison, the type of container cap illustrated in copending application Ser. No. 565,737 filed 12/27/83 is what can be described as an end-mounted closure.

However, it will be apparent to those skilled in the art that the present invention broadly is applicable to end-mounting as well as side-mounting.

Figure 2:
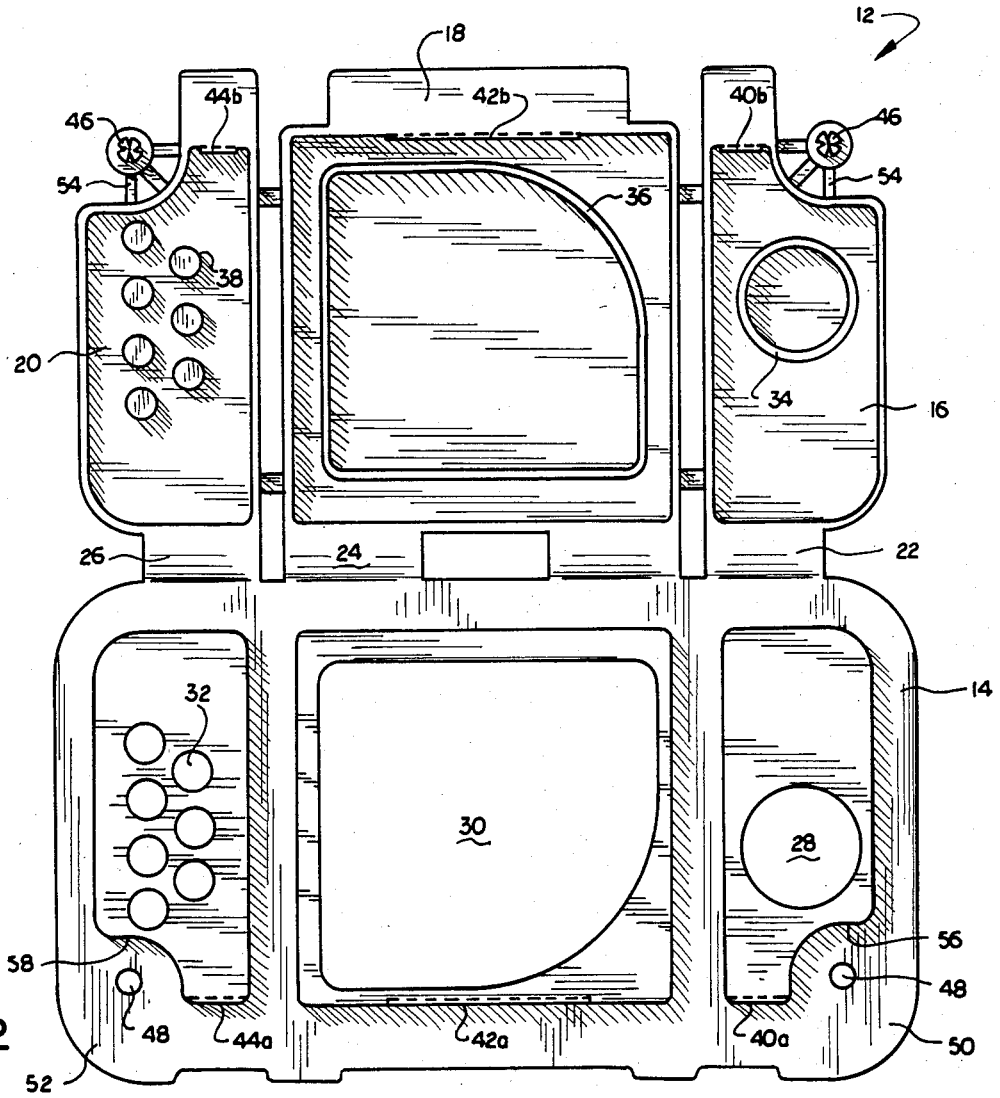
FIG. 2 is a plan view of the container cap of FIG. 1 with the components in an open position.

As described in Kirkpatrick U.S. Pat. No. 3,397,823, lids 16, 18 and 20 are provided with cooperating, shaped, protuberances 34, 36 and 38 on the underside of the lids adapted to close the openings 28, 30 and 32, respectively, of the cover member, when the lids are folded over onto the cover member. The container cap can be molded in one piece from any suitable thermoplastic material, such as polyethylene, polyolefin, or polypropylene. The molding is carried out with the cover member and lids in the open position as shown in FIG. 2, for ease of molding. The design of the cap thus becomes important; namely, providing a hinge means adapted to permit the lids to move a full 180°, half-circle to reach either the open or closed position. End or side mounting permits such movement.

Figure 4:
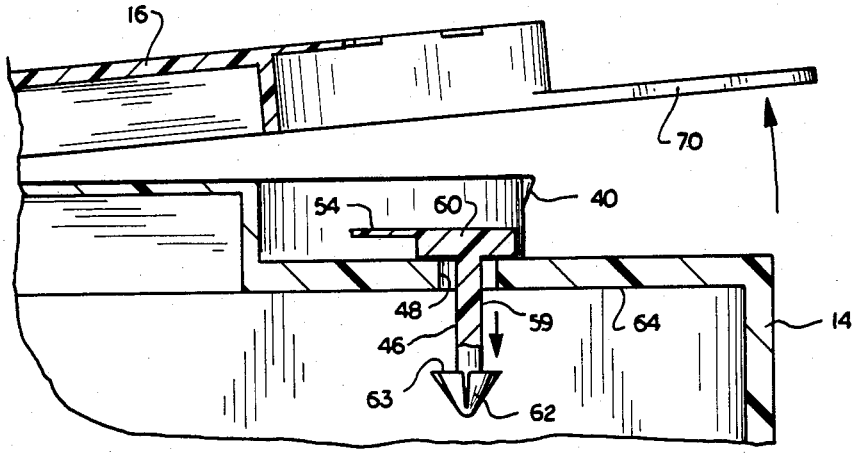
FIG. 4 is a partial, enlarged section elevation view similar to that of FIG. 3 but with components of the cap in a partially opened position and the tamper evidencing means ruptured.

When the cover member is mounted on a container, there is a natural tendency of the lids to return to the open position due to the elasticity or memory of the plastic hinges. To hold the lids in a folded-over, closed position, superimposed against the upper surface of the cover member, there are provided cooperating catch elements 40 (*a* and *b*), 42 (*a* and *b*), and 44 (*a* and *b*) (FIG. 2) adapted to hold the lids against the natural bias of the hinges. An example of such a releasable latching means is illustrated in FIG. 4, protuberance 40 on the cover front edge engaging a cooperating recess in the lid (not shown).

Figure 3:
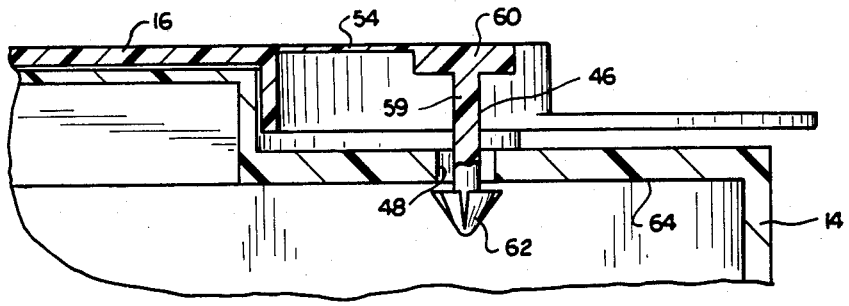
FIG. 3 is a partial, enlarged, section elevation view showing the tamper evidencing means of the present invention for locking together components of the cap of FIG. 2.

In the practice of the present invention, the tamper evidencing means comprises pins 46, shown best in FIG. 3, which are adapted to penetrate holes 48 in the cover member 14. The holes 48 are positioned in the two corners 50 and 52 (FIGS. 2 and 5) of the cover member farthermost removed from the side on which the hinges 22, 24 and 26 are located. The pins 46 are located or attached to the lids 16 and 20 so that when the same are folded over into a superimposed relationship with the cover, the pins can easily penetrate the holes 48.

As shown in FIG. 2 the pins 46 are attached to the lids by means of webbing 54, the lids being slightly cut away at areas 56 and 58 to accomodate the pins and webbing. The pins 46 are provided, as shown in FIGS. 3 and 4, with elongated shanks 59 having head portions 60 of substantially larger diameter than the shanks, and arrowhead configurations 62 on their lowermost ends compressible to permit insertion of the pins through the holes 48. The arrowheads 62 however, are provided with flattened inner shoulders 63 adapted to engage and lock against the underside 64 of cover member 14.

Thus, when the lids are closed against the cover, the pins are snapped through the holes 48 and then the lids are held in the closed position, locked by the arrowhead configuration of the pins 46.

It should be evident that the head portion 60 of the pins not only provides a seat for webbing 54, attaching the pins to the lids, but also prevents the pins from dropping down into the contents of the container when the webbing is broken. Obviously, the webbing could sever close to the heads 60 or removed from the heads.

Figure 1:
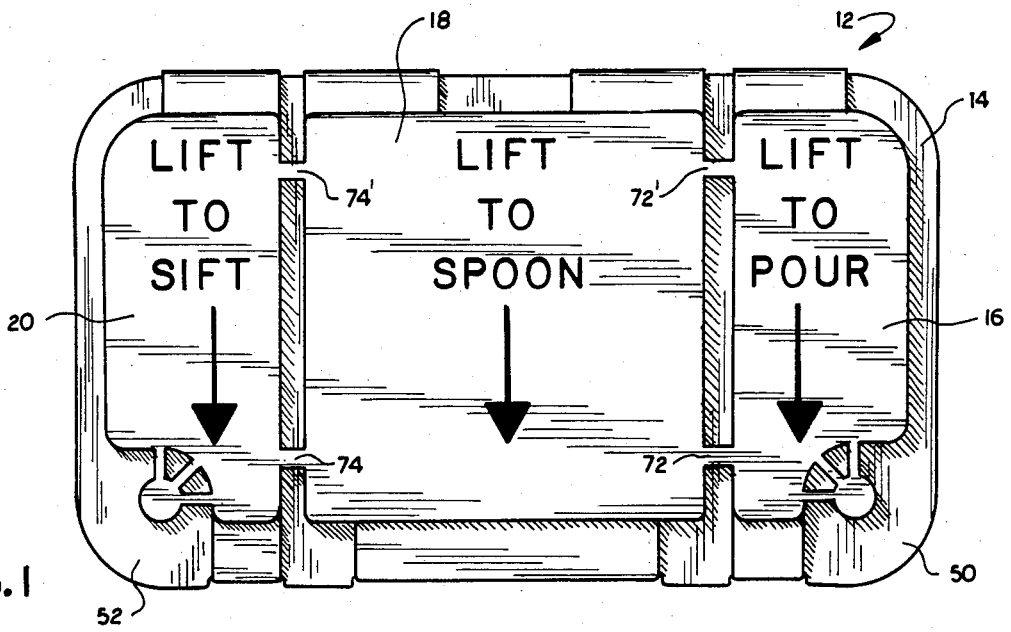
FIG. 1 is a plan view of the container cap of the present invention showing the cap components in a closed position.
Figure 5:
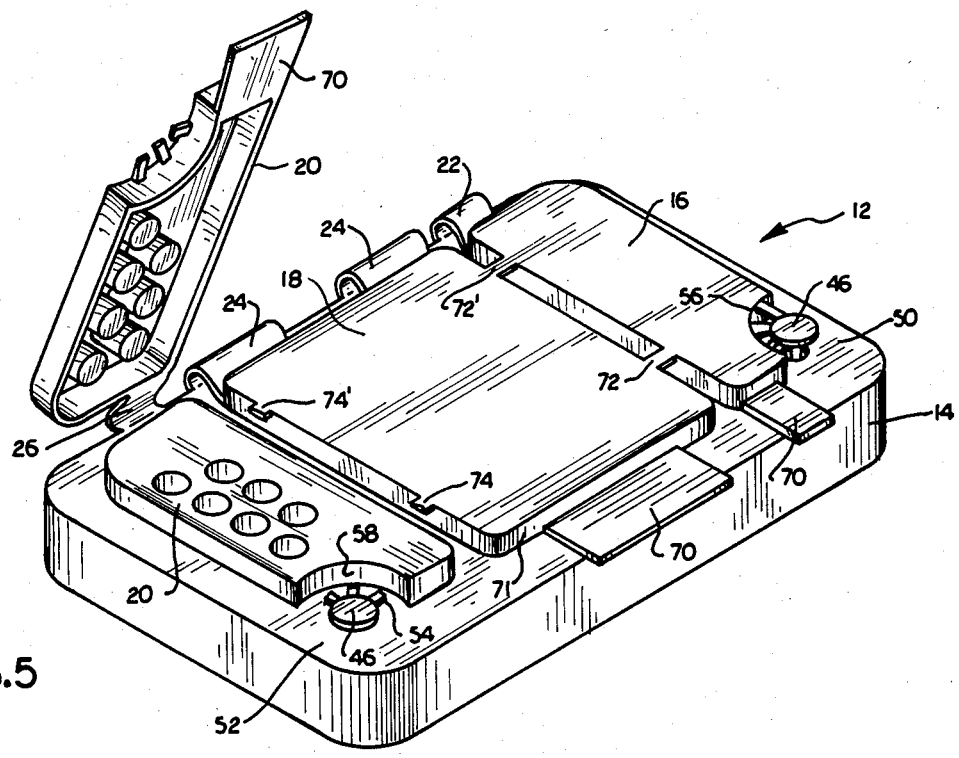
FIG. 5 is a perspective view of the container cap of FIG. 1 showing one of the cap lids in a raised position, and other lids in a still secured, closed position

Since in the embodiment illustrated in the drawings, there are provided three separate lids 16, 18 and 20, the tamper evidencing means also includes webbing 72 and 74 (FIGS. 1 and 5) connected between the respective lids 16/18 and 18/20. As shown in FIG. 5, to raise lid 20 it is necessary to break not only the webbing 54, but also the webbing 74. In operation, the container is filled before the cover is placed on it. Prior to pressing the cover in place on the container, the lids 16, 18 and 20, following molding, are folded over into an overlapping relationship with the cover member 14 and secured in a closed position by locking the pins 46 into holes 48. At this point, the cover is then pressed into position on the container. Then, to open the lids, tabs 70 along the unhinged edges 71 (FIG. 5) of the lids are grasped by the consumer and lifted, raising the lids and breaking the webbing 54, 72 and 74, as illustrated in FIGS. 4 and 5.

The method of securing the cover member 14 to the container is not part of this invention. If desired, the concepts set forth in prior application Ser. No. 565,737 can be employed. In essence, the downwardly extending flange of the cover member has an upside-down "Y" configuration defining inner and outer skirts extending around the periphery of the cover member which engage the opposite inside and outside surfaces of an upstanding neck of the container. The inner skirt may have a lip or other protruberance engaging the inside of the container neck to assist in holding the cover member in place.

Prior application Ser. No. 565,737 describes a tamper evidencing means for the outer skirt which would show evidence of attempt to raise the outer skirt towards gaining access to the inside of the container, via passage between the cover skirt and container. For this purpose, the outer skirt may be provided with a plurality of spaced-apart weakened zones, which are in the form of elongated V-shaped notches, positioned vertically in the skirt, around the skirt periphery. An attempt to raise a part of the outer skirt causes rupture of one or more of the weakened zones.

There also may be one or more elongated weakened zones positioned horizontally in the outer skirt, for instance at or near the point of connection of the outer skirt with the inner skirt. Here also, an attempt to raise the outer skirt would result in rupture along one or a portion of the weakened zones or zone, showing evidence of tampering. This portion of the disclosure of Ser. No. 565,737 is incorporated by reference herein.

Preferably, each lid is secured against opening prior to lifing on tab 70, by at least three points more or less equally positioned around the periphery of each lid. In other words, referring to lid 16, this is secured not only at hinge 22, but also in one corner by the right-hand pin 46 and also by the webbing 72. In other words, the lid is secured by at least three periodic spaced-apart intervals, which, if visualized in the form of a circle, would be at about 90° to about 120° apart on the circle. In the drawing of FIG. 5, additional web connections 72' and 74' between the lids 16, 18 and 20 provide further security for the centermost lid 18, as well as two spaced-apart hinges 24. Thus, the centermost lid has a total of five connections.

Accordingly, by the present invention, it is impossible, despite the flexibility of the plastic material used, for a would-be tamperer to obtain access to the contents of a can covered by the container cap, for instance, by attempting to raise a corner of one of the lids without breaking a web, which would be quickly evident to a purchaser of the can.

Although the present invention has been described with regard to a container cap having multiple lids, the principals of the present invention are applicable to caps having just a single lid. In such instances, the hinge would provide resistance to access along one side of the cap and then pins positioned at opposite free corners of the lid, about 120° from the hinge, would firmly hold the lid to the cover.

Similarly, the present invention can be practiced with the so-called, end-mounted lids, or with two lids side by side.

Figure 6:
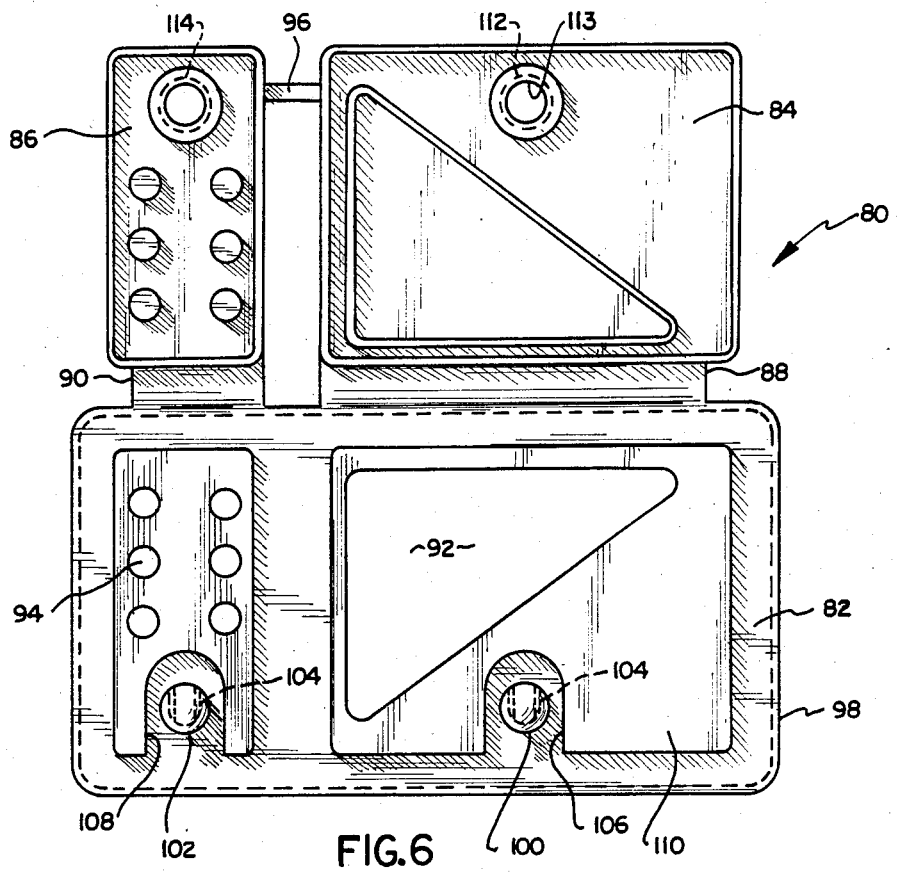
FIG. 6 is a plan view of an embodiment of the container cap of the present invention, showing the cap in an open, molded position.
Figure 7:
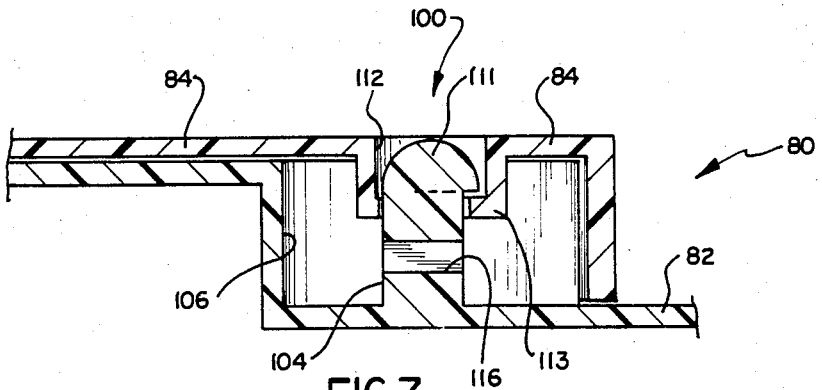
FIG. 7 is a side, elevation, section view showing details of the arrowhead lock arrangement of the container cap of FIG. 6.

In the embodiment shown in FIGS. 6 and 7, the overall arrangement of component parts is similar, the cap 80 comprising cover member 82 and lids 84 and 86 hinged to the cover member at hinges 88 and 90. The cover is provided with a spoon hole 92, aligned with lid 84, and sifting holes 94 aligned with lid 86. Web 96 connects lids 84 and 86, as in the embodiment of FIGS. 1–5. Similarly, the skirt 98, of the cover member, is provided with weakened vertical areas designed to rupture on raising the skirt to gain access to the can contents, as in the embodiment of FIGS. 1–5.

The novelty in the embodiment of FIGS. 6 and 7 lies in the utilization of the arrowhead locks 100 and 102 for the respective lids. The locks are integral parts of the cover member, as shown in FIG. 7, rather than the lids, and are provided with shank portions 104 (FIG. 7) extending upwardly from recessed areas 106 and 108 in the upper surface 110 of the cover member. They are centered with regard to the direction of movement of the lids 84 and 86 to engage the front edges of the lids (in the centers thereof), and are provided with mushroom head portions 111 (FIG. 7) adapted to engage the inwardly directed lips 113 of apertures 112 in the lids. The weakened areas are in the shank portions and in essence comprise rectangular aperture 116 extending horizontally through the shanks from front to back, limiting each shank structure to opposed connecting side bridges in the area of the aperture 116. In operation, the shanks are easily ruptured on raising the lids 84 and 86, exposing the shank ends, giving to a purchaser clear evidence of prior opening or tampering.

Details of the arrangement of component parts should be evident from the drawings.

The arrowhead lock mushroom heads are circular, as shown in FIG. 6, but the lip of the head protrudes outwardly from the shank only in the front and along the sides but not in the rear (FIG. 7). This facilitates molding. Apertures 116 extend completely through the shanks horizontally, and are rectangular in configuration. The purpose of this is also to facilitate manufacture. These apertures 116 are formed by a cross slide which projects into the mold cavity prior to molding, and is withdrawn prior to mold release.

It should be noted that the embodiment of FIGS. 1–5 could also be manufactured with a weakened shank rather than webbing. Similarly, webbing could be utilized in the present instance to secure the arrowhead shank to the cover member, rather than use of a weakened shank.

I claim:

1. A tamper evidencing container cap comprising (a) a rectangular shaped cover member;

(b) means defining a plurality of openings in said cover member for pouring, spooning, or sifting container contents confined by said cover member;

(c) at least two side-by-side lids;

(d) hinge means side connecting each of said lids to said cover member;

(e) said lids being adapted to close said cover member openings when the lids are folded on the hinge means into a superimposed relationship with the cover member;

(f) arrow shaped locking means adapted to penetrate holes in said cover member and to engage said cover member in a locking relationship through said holes, including first breakable tamper evidencing means directly connecting said locking means to said lids;

(g) said locking means having enlarged base means to prevent the locking means from falling through said openings into the container contents, said tamper evidencing means in the unbroken state holding the top of said base means in essentially the same plane as that of said lids, in the broken state the top of the base means lying below the plane of said lids; and (h) second breakable tamper evidencing means connecting said lids together.

2. The cap of claim 1 wherein said lids are in the shape of tetrahedrons with the locking means at corners of the lids at about 120° from the hinged means.

3. The cap of claims 1 or 2 including three lids side by side, the locking means being at opposed corners of the first and third lids, furthermost removed from the hinge means and each other, the second breakable tamper evidencing means comprising at least two webs connecting the centermost lid to each of the first and third lids.

4. A container cap comprising (a) a cover member;

(b) at least one opening in the cover member;

(c) lid means including at least one lid to close said opening;

(d) flexible hinge means connecting the lid means to the cover member and defining free edge means opposite said hinge means; and (e) tamper evidencing means in the form of arrowhead locks, positioned adjacent said free edge means, securing the lid means to the cover member, said tamper evidencing means inluding breakable webbing directly connecting said locks to the lid means wherein in the unbroken state the top of the arrowhead locks lies in a first plane and in the broken state in a plane below that of the unbroken state.

5. The cap of claim 4 including at least two lids, said lids having aligned free edges, further including breakable webbing between the two lids.

6. The cap of claim 5 including three lids, said locks being at the furthermost spaced-apart corners of said lid means.

7. A tamper evidencing container cap constructed of a flexible molded plastic material comprising (a) a cover member;

(b) at least one opening in the cover member;

(c) lid means including at least one lid to close said opening;

(d) flexible hinge means connecting said lid to the cover member, by which said lid is foldable over onto the cover member into a superimposed relationship with the cover member to close said opening; said lid having a free edge opposite said hinge means; and (e) tamper evidencing means in said free edge in the form of at least one arrowhead lock including a head portion and a shank portion, said lock directly engaging both said free edge and said cover member, said arrowhead lock comprising weakened means in the shank portion adapted to rupture and exhibit an exposed ruptured surface on first raising said lid from said superimposed relationship.

8. A tamper evidencing container cap constructed of a flexible molded plastic material comprising (a) a cover member;

(b) at least one opening in the cover member;

(c) lid means including at least one lid to close said opening;

(d) flexible hinge means connecting said lid to the cover member, by which said lid is foldable over onto the cover member into a superimposed relationship with the cover member to close said opening, said lid having a free edge opposite said hinge means; and (e) tamper evidencing means in said free edge in the form of at least one arrowhead lock directly engaging both said free edge and said cover member, said arrowhead lock comprising weakened means adapted to rupture and exhibit an exposed ruptured surface on first raising said lid from said superimposed relationship;

(1) said arrowhead lock comprising a shank portion affixed to the cover member and an exposed head portion engaging said lid, the weakened means being in the arrowhead shank portion.

9. The cap of claim 8 wherein said lid comprises a recessed area in the lid free edge such that said exposed head portion is generally flush with the lid exposed surface when the lid is in a folded superimposed relationship with the cover member.

10. The cap of claim 8 wherein said lid comprises a recessed aperture means aligned with the arrowhead lock when the lid and cover are in said superimposed relationship, said lock comprising an arrow configuration at its exposed end adapted to non-releasably penetrate said aperture means.

11. The cap of claim 4 wherein the top of the arrowhead lock in the unbroken state lies in essentially the same plane as the lid means.

* * * * *